United States Patent [19]

Okumichi et al.

[11] 4,296,012

[45] Oct. 20, 1981

[54] SIZING COMPOSITIONS INCORPORATING KETENE DIMER

[75] Inventors: Toshiharu Okumichi; Osamu Oseto, both of Suita; Keizo Matsumoto, Hirakata; Shigenori Thuzimoto; Hisanari Sanda, both of Osaka, all of Japan

[73] Assignee: Arakawa Kagaku Kogyo Kabushiki Kaisha, Japan

[21] Appl. No.: 101,768

[22] Filed: Dec. 10, 1979

[30] Foreign Application Priority Data

Dec. 28, 1978 [JP] Japan ..... 53-161560
Feb. 28, 1979 [JP] Japan ..... 54-23631

[51] Int. Cl.[3] ..... C08L 23/18; C08L 25/06; C08L 95/00

[52] U.S. Cl. ..... 260/29.6 XA; 106/285; 106/287.2; 106/287.24; 162/164 R; 162/168 R; 162/173; 260/9; 260/17.4 ST; 260/17.5; 260/23 H; 260/27 R; 260/29.4 UA; 260/29.6 NR

[58] Field of Search ..... 260/29.6 XA; 106/285, 106/287.2, 287.24

[56] References Cited

U.S. PATENT DOCUMENTS 3,922,243 11/1975 Aldrich et al. ..... 260/29.2 EP

*Primary Examiner*—Harold D. Anderson
*Attorney, Agent, or Firm*—Larson and Taylor

[57] ABSTRACT

This invention provides a sizing composition for cellulosic fiber sheets comprising water and finely divided solid particles dispersed in the water, said particles being a uniform mixture of about 40 to about 96% by weight of a ketene dimer and about 4 to about 60% by weight of a noncrystalline hydrocarbon resin; and a process for preparing the sizing composition.

The sizing composition of this invention is excellent both in sizing effects and in stabilities.

7 Claims, No Drawings

SIZING COMPOSITIONS INCORPORATING KETENE DIMER

This invention relates to sizing compositions incorporating a ketene dimer and suitable for sizing paper, paperboard and like cellulosic fiber sheets.

Papers, paperboards, wood fiber boards and like sheets of cellulose fibers are produced usually from aqueous dispersions of cellulose fibers containing sizing agents admixed therewith. Generally used as such sizing agents are those of the rosin type which are capable of giving the resulting product resistance to water and to the penetration of ink. However, the rosin-type sizing agents are unable to produce the desired effect unless they are used conjointly with alum for fixing cellulose fibers. When the sizing agents of this type are used, therefore, the sheet making process must inevitably be practiced in an acid pH range. This entails various problems such as deterioration of the product, cumbersome treatment of the waste water, corrosion of the sheet making machine, etc., further imposing serious limitations on the use and processability of the product. While a filler is added to the stock to improve the opacity, brightness and other properties of paper, the use of a basic filler, especially inexpensive calcium carbonate, involves drawbacks; calcium carbonate decomposes during papermaking in the acidic pH range, evolving carbon dioxide gas to cause troubles to the operation.

On the other hand, sizing compositions incorporating a ketene dimer as dispersed in water are known as sizing agents which are usable outside the acidic pH range. The sizing agents of this type do not require the use of an acidic fixing agent such as alum but react directly with cellulose fibers to impart water resistance to the fibers and are therefore usable for papermaking in the neutral range without entailing the foregoing drawbacks experienced in the acid range. The aqueous dispersions of ketene dimers nevertheless are inherently unstable and have the serious defect of being low in storage, mechanical and chemical stabilities. Stated more specifically, the ketene dimers useful as sizing agents are highly prone to crystallization in themselves, such that when the dimers are formulated into aqueous dispersions, crystallization is likely to take place in a relatively short period of time, with the result that the particles of the dispersed phase separate out from the dispersion. The aqueous dispersion is liable to gel when subjected to a shearing action. This tendency becomes more pronounced after the dispersion has been stored at low temperatures. For example, when stored at 3° to 10° C. and thereafter subjected to mechanical shear, the dispersion readily gels and no longer restores itself to the original dispersion.

Various attempts so far made to impart improved stability to the aqueous dispersion of ketene dimer have matured to some commercial sizing dispersions with high stability. The commercial compositions, however, have an extremely low sizing effect and are not satisfactorily useful. Moreover the known sizing compositions of the ketene dimer type have the drawback of affording papers and like cellulose fiber products which are low in strength, e.g. in burst strength and in coefficient of friction. Additionally they are more expensive to manufacture than other sizing compositions, and therefore are not economically advantageous.

An object of this invention is to provide sizing compositions of the ketene dimer type which are usable for making papers, paperboards, wood fiber boards and like cellulosic fiber sheets in the neutral range and which are free of the foregoing drawbacks of the ketene dimer type.

Another object of the invention is to provide useful sizing compositions incorporating a ketene dimer which are outstanding in storage and mechanical stabilities.

Another object of the invention is to provide sizing compositions incorporating a ketene dimer which are capable of giving outstanding sizing effects and excellent water resistance to cellulose fiber products although retaining high stabilities.

Another object of the invention is to provide sizing compositions incorporating a ketene dimer which is capable of imparting outstanding sizing effects to cellulose fiber products without substantially reducing the strength and coefficient of friction of the products.

Still another object of the invention is to provide sizing compositions of the ketene dimer type which can be manufactured at a low cost and which are usable economically advantageously.

These objects and other features of this invention will become apparent from the following description.

This invention provides sizing compositions for paper comprising water and finely divided solid particles dispersed in the water, said solid particles being a uniform mixture of about 40 to about 96% by weight of a ketene dimer and about 4 to about 60% by weight of a noncrystalline hydrocarbon resin.

The term "uniform mixture", as used in the specification and in the appended claims and referring to the solid particles which constitute the sizing composition, means that the ketene dimer and the noncrystalline hydrocarbon resin are homogeneously mixed and united by dissolving one in the other. Dissolving one component in the other can be accomplished by melting the two components together.

We have found that when the solid particles, of which a sizing composition is comprised, are a uniform mixture of a ketene dimer and a noncrystalline hydrocarbon resin in specified proportions, the particles dispersed in water remain intact against breaking, rendering the dispersion free of gelation and permitting the dispersion to retain greatly improved storage and mechanical stabilities, even when the dispersion is stored for a prolonged period of time and subjected to mechanical shear.

Further we have found that the sizing composition comprised of the above solid particles of the uniform mixture gives outstanding sizing effects (to afford water resistance) to cellulose fiber products without substantially reducing the strength and coefficient of friction of the products, although the composition retains greatly improved stabilities. Unless the solid particles comprise such a uniform mixture, the outstanding effects described above are not achievable. Mixtures of a ketene dimer dispersion and a noncrystalline hydrocarbon resin dispersion fail to exhibit the desired stability. Additionally, the sizing effect of the mixture, which is dependent only on the proportion of the ketene dimer dispersion, inevitably reduces with an increase in the proportion of the noncrystalline hydrocarbon resin dispersion, because the hydrocarbon resin has a very poor sizing effect as well known. Such resin becomes usable as a sizing agent only when subjected to primary modification as by maleinization and to subsequent secondary modification such as introduction of amino groups. Thus when an amount of the dispersion of the noncrystalline hydrocarbon resin is admixed with the aqueous dispersion of a ketene dimer, the resulting mixture exhibits a correspondingly reduced sizing effect. Suprisingly however particles of a uniform mixture of the noncrystalline hydrocarbon resin and the ketene dimer affords, a novel sizing composition which is outstanding in both stability and sizing effect despite the use of the noncrystalline hydrocarbon resin. This invention has been accomplished based on these findings. In addition the sizing composition of this invention has another advantage that it imparts water resistance to the product promptly after the sheet making process, assuring facilitated process control and easier subsequent processing for the product.

Various known ketene dimers are usable for the preparation of the sizing compositions of this invention. Typical of such ketene dimers are represented by the formula

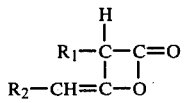

wherein $R_1$ and $R_2$ are the same or different and each represent a hydrocarbon residue having 8 to 30, preferably 10 to 20, carbon atoms. Examples of such hydrocarbon residues are alkyl groups such as octyl, nonyl, decyl, undecyl, dodecyl, tridecyl, tetradecyl, pentadecyl, hexadecyl, heptadecyl, octadecyl, eicosyl, etc.; alkenyl groups such as decenyl, tridecenyl, hexadecenyl, octadecenyl, eicosenyl, etc.; alkylaryl groups such as p-tert-butylphenyl, octylphenyl, nonylphenyl, dodecylphenyl, etc.; alkyl- substituted cycloalkyl groups such as nonylcyclopropyl, dodecylcyclohexyl, etc.; and aralkyl groups such as phenylethyl, etc. Preferable among the ketene dimers are alkyl ketene dimers which represented by the above formula wherein $R_1$ and $R_2$ are the same or different and each represent an alkyl group having 8 to 30, more preferably 10 to 20, carbon atoms. The ketene dimers are usable alone, or two or more of them can be used in admixture.

According to this invention, any noncrystalline hydrocarbon resins are usable in combination with a ketene dimer insofar as they are compatible with the ketene dimer. Examples of such hydrocarbon resins are natural or synthetic hydrocarbon resins, typical of which are polymers or copolymers prepared by the radical polymerization, cationic polymerization, anionic polymerization, thermal addition polymerization or like of various ethylenically unsaturated hydrocarbons. Also usable are hydrogenated products of such polymers or copolymers. Examples of ethylenically unsaturated hydrocarbons useful for the preparation of the noncrystalline hydrocarbon resins are:

(a) Olefins or diolefins available from the petrochemical industry including aliphatic or cyclic olefins such as butene, isobutene, pentene, cyclopentene, hexene, cyclohexene, etc.; aliphatic or cyclic diolefins such as butadiene, isoprene, piperylene, cyclopentadiene, dicyclopentadiene, etc.; and aromatic olefins such as styrene, $\alpha$-methylstyrene, vinyltoluene, indene, isopropenyltoluene, etc.; and (b) terpenes such as $\alpha$-pinene, $\beta$-pinene, camphene, dipentene, etc.

Noncrystalline hydrocarbon resins useful in this invention are usually those which are liquid at room temperature, or those which are solid at room temperature. Useful solid resins have a softening point of up to about 150° C. as determined by the ring-and-ball method. Useful noncrystalline hydrocarbon resins which are liquid at room temperature have a viscosity (Brookfield viscosity) usually of above about 100 cps, preferably above about 200 cps at 20° C. Useful noncrystalline hydrocarbon resins which are solid at room temperature are divided into those having a lower softening point of up to about 45° C. and those having a higher softening point of above about 45° C. The former resins include those which are semisolid at room temperature. Preferable among the latter resins are those having a softening point of about 60° to about 120° C.

Although useful noncrystalline hydrocarbon resins are not particularly limited in molecular weight, desirable are those having an average molecular weight usually of about 300 to about 3000, preferably about 400 to about 2000, as determined by the Rast method.

Although the proportions of the ketene dimer and the noncrystalline hydrocarbon resin in the uniform mixture are not limitative, it is suitable to use usually about 40 to about 96% by weight, preferably about 50 to about 95% by weight, of the ketene dimer and about 4 to about 60% by weight, preferably about 5 to about 50% by weight, of the noncrystalline hydrocarbon resin. With more than 96% by weight of the ketene dimer present, the effect especially the stability of the dispersion to be afforded by the use of the noncrystalline hydrocarbon resin decreases, whereas with a reduction in the amount of the ketene dimer from a level much lower than 40% by weight, the water resistance imparting effect will gradually decrease.

The sizing compositions of this invention are prepared by melting the ketene dimer and the noncrystalline hydrocarbon resin in mixture with heating to cause them to uniformly dissolve in each other and dispersing the resulting uniform mixture in water in the presence of a dispersant. The dispersed phase thus prepared comprises solid particles of the uniform mixture of the ketene dimer and the noncrystalline hydrocarbon resin. The two ingredients are melted at any temperature insofar as they can be melted in mixture. The temperature is usually up to about 150° C., preferably up to about 100° C. The resulting solution is dispersed usually at about 50° to about 80°. Too high a temperature, if used, is likely to cause hydrolysis of the ketene dimer.

Dispersants useful for the preparation of the present sizing compositions are cationic dispersants already known for use with ketene dimer sizing agents or mixtures of a cationic dispersant and a nonionic or anionic dispersant. Cationic starches containing primary, secondary, tertiary or quaternary amino groups are preferable cationic dispersants. Examples of useful cationic starches are prepared by decomposing corn, tapioca; potato, wheat or like starch with hydrogen peroxide or sodium hypochlorite and reacting the product with diethylaminoethyl chloride or like cationizing agent for cationic modification, with or without further addition of ethylene oxide or propylene oxide to the modified product to give improved dispersibility to the product. Also usable are polyethyleneimine, polyethyleneimine-epichlorohydrin condensation product, aminopolyamideepichlorohydrin resin, polyvinylpyridine, styrene-dimethylaminoethyl methacrylate copolymer, cationic polyurethane resin, dicyandiamido-formaldehyde resin, urea-formaldehyde resin, melamine-formaldehyde resin, dimethylamineepichlorohydrin resin, etc. Examples of nonionic dispersant conjointly usable with such cationic dispersants are polyvinyl alcohol, oxidized starch, etc. Examples of useful anionic dispersants are sodium naphthanelenesulfonate-formaldehyde condensate, sodium lignosulfonate, etc. The cationic dispersant can be replaced by the nonionic dispersant in an amount of about 50% by weight of the former and/or by the anionic dispersant in an amount of about 10% by weight of the cationic dispersant.

It is preferable to use these dispersants in an amount of about 10 to about 100% by weight, more preferably about 15 to about 50% by weight, based on the uniform mixture of the ketene dimer and the noncrystalline hydrocarbon resin, whereby an aqueous dispersion can be obtained with improved homogeneity.

The aqueous dispersion thus prepared contains up to about 30% by weight, preferably about 10 to about 20% by weight, of the uniform mixture of ketene dimer and noncrystalline hydrocarbon resin. The dispersion contains the uniform mixture in the form of fine particles of up to about 1 μm in size, has high stability and is usable as it is or as diluted for sizing purposes.

The sizing compositions incorporating ketene dimer according to this invention are useful for preparing papers, boards and other sheets not only from cellulose fibers but also from mixtures of cellulose fibers and mineral fibers as of asbestos, rock wool or the like, or synthetic fibers as of polyamide, polyester, polyolefin or the like.

For internal sizing, the present sizing compositions are added to an aqueous slurry of cellulose fibers usually in an amount of about 0.005 to about 3% by weight, preferably about 0.01 to about 2% by weight, calculated as solids and based on the dry weight of the fibers. Further for internal sizing, a usual cationic high-molecular-weight substance, serving as a fixing agent, is usable conjointly with the present composition, usually in an amount of about 0.001 to about 3% by weight, preferably about 0.005 to about 1% by weight, based on the dry weight of the fibers, whereby the effect of the present sizing composition can be greatly enhanced. Preferable examples of such substances are acrylamidedimethylaminoethyl methacrylate copolymer, polyacrylamide modified by the Mannich reaction, polyacrylamide modified by the Hofmann reaction or like cationic acrylamide copolymer, and amphoteric acrylamide copolymer. The aforementioned cationic dispersants are also usable as such cationic high-molecular-weight substances.

The ketene dimer-incorporating sizing compositions of this invention are also usable for the surface sizing of papers, paperboards, wood fiber boards, etc. by coating or impregnation.

The invention will be described below in greater detail with reference to examples, in which all the parts and percentages are by weight unless otherwise specified.

EXAMPLE 1

Ketene dimer (KD)

A mixture comprising ketene dimer of palmitic acid, ketene dimer of stearic acid and ketene codimer of palmitic acid and stearic acid, obtained by reacting a mixture of palmitoyl chloride (70%) and stearoyl chloride (30%) in benzene in the presence of triethylamine, in a combined yield of 98%.

Noncrystalline hydrocarbon resin A (HCR-A)

Polybutene 770 in molecular weight and 1600 cps in viscosity at 20° C.

Dispersant A

Cooked cationic starch (N content: 0.5%) having a viscosity of 30 cps at 25° C. when made into a 10% aqueous solution.

The KD and HCR-A in the proportions (by weight) listed in Table 1 are mixed together with heating, and 50 g of the mixture, 125 g of 10% aqueous solution of the dispersant A and 290 g of distilled water are heated to 70° C. and pretreated in a homomixer. The resulting dispersion is further passed through a homogenizer (shearing pressure 350 kg/cm$^2$) twice at the same temperature to prepare a uniform dispersion. The dispersion is cooled and then filtered by a 350-mesh wire to obtain an aqueous dispersion. Little or no (less than 0.007%) solids are filtered off.

For comparison, the same procedure as above is repeated except that the KD and HCR-A are used respectively alone to obtain aqueous dispersions.

These aqueous dispersions contain about 15% of nonvolatile component, have a pH of 4.2 to 4.5 and a viscosity of 10 to 15 cps and composed of particles up to 0.5 μm in size.

The dispersions are tested for stability by the following methods.

Method (a)

A 50 g portion of the aqueous dispersion is weighed out immediately after preparation and placed into a 100-ml beaker, which is then placed on a magnetic stirrer. The stirrer piece (3 cm in length) is driven at 500 r.p.m. to check the dispersion for gelation.

Method (b)

The dispersion is preserved at 5° C. for 24 hours immediately after preparation and then allowed to stand at room temperature for 24 hours. The dispersion is thereafter tested in the same manner as in the method (a).

Table 1 shows the results.

TABLE 1

| No. | KD:HCR-A (by wt.) | Stability Method (a) | Stability Method (b) |
|---|---|---|---|
| 1 | 100:0 | Gelation in 6 hrs. | Gelation in 2.5 hrs. |
| 2 | 95:5 | No change in 6 hrs. | No change in 6 hrs. |
| 3 | 90:10 | No change in 6 hrs. | No change in 6 hrs. |
| 4 | 80:20 | No change in 6 hrs. | No change in 6 hrs. |
| 5 | 70:30 | No change in 6 hrs. | No change in 6 hrs. |
| 6 | 60:40 | No change in 6 hrs. | No change in 6 hrs. |
| 7 | 0:100 | No change in 6 hrs. | No change in 6 hrs. |

Paper specimens are prepared in the following manner with use of the seven dispersions listed above and a commercial aqueous dispersion of ketene dimer (nonvolatile component 16.2%, pH 3.6, viscosity 8 cps) as papermaking sizing compositions.

To 1% aqueous slurry of a pulp (L-BKP) 435 ml in Canadian Standard Freeness is added 0.3% (calculated as nonvolatile component) of the dispersion based on the pulp, and the slurry is made into a sheet weighing 60±1 g/m² by a TAPPI standard sheet machine. The wet sheet is pressed at 3 kg/cm² for 5 minutes, then dried in a rotary dryer at 100° C. for 1 minute and thereafter conditioned at 20° C. and 65% R.H. for 24 hours.

The Stöckigt sizing degree (JIS P 8122), burst factor (JIS P 8112) and coefficient of friction (JIS C 6244) of the paper specimens are measured. Table 2 shows the results.

For comparison, an aqueous dispersion of KD and an aqueous dispersion of HCR-A are mixed together in ratios by weight of 80:20 and 60:40 to obtain mixtures, which are tested as sizing compositions No. a and No. b respectively in the same manner as above. The results are also given in Table 2.

TABLE 2

| Sizing comp. No. | Sizing degree (sec) | Burst factor | Coefficient of friction |
|---|---|---|---|
| 1 | 24.8 | 3.20 | 0.428 |
| 2 | 25.3 | 3.25 | 0.432 |
| 3 | 24.2 | 3.36 | 0.441 |
| 4 | 25.5 | 3.38 | 0.448 |
| 5 | 24.1 | 3.42 | 0.467 |
| 6 | 23.6 | 3.51 | 0.475 |
| 7 | 0 | 3.62 | 0.482 |
| Commercial product | 0 | — | — |
| Commercial product* | 2.1 | — | — |
| a | 17.2 | — | — |
| b | 7.2 | — | — |
| (Blank) | 0 | 3.75 | 0.490 |

The mark "-" indicates that the specimen is not measured.

In Table 2, the commercial product asterisked is used in an amount of 0.5% (calculated as nonvolatile component) based on the pulp.

EXAMPLE 2

Noncrystalline hydrocarbon resin B (HCR-NB)

Polyisobutene 570 in molecular weight and 900 cps in viscosity at 20° C.

Noncrystalline hydrocarbon resin C (HCR-C)

Polyisobutene 1260 in molecular weight and 30000 cps in viscosity at 20° C.

Noncrystalline hydrocarbon resin D (HCR-D)

Polybutadiene (1,4-addition rich) 1700 in molecular weight and 750 cps in viscosity at 20° C.

Noncrystalline hydrocarbon resin E (HCR-E)

Polypiperylene 950 in molecular weight and 5° to 10° C. in softening point.

Noncrystalline hydrocarbon resin F (HCR-F)

Polybutadiene (1,2-addition rich) 1000 in molecular weight and 35000 cps in viscosity at 20° C.

Dispersant B

Prepared by the addition reaction of cationic starch (N content 0.5%) and propylene oxide (2% based on the starch) and cooking the product, the dispersion having a viscosity of 30 cps at 25° C. when made into a 10% aqueous solution.

Ketene dimer-incorporating sizing compositions are prepared in the same manner as in Example 1 except that the above noncrystalline hydrocarbon resins are used in the proportions listed in Table 3 in place of the HCR-A, along with the dispersant B in place of the dispersant A. The dispersions are comparable to those in Example 1 in nonvolatile content, pH, viscosity and particle size. The dispersions are also tested for stability with the results given in Table 3.

TABLE 3

| No. | HCR | KD:HCR (by wt.) | Stability Method (a) | Stability Method (b) |
|---|---|---|---|---|
| 8 | HCR-B | 80:20 | No change in 24 hrs. | No change in 24 hrs. |
| 9 | " | 60:40 | No change in 24 hrs. | No change in 24 hrs. |
| 10 | HCR-C | 80:20 | No change in 24 hrs. | No change in 24 hrs. |
| 11 | " | 60:40 | No change in 24 hrs. | No change in 24 hrs. |
| 12 | HCR-D | 80:20 | No change in 24 hrs. | No change in 24 hrs. |
| 13 | " | 60:40 | No change in 24 hrs. | No change in 24 hrs. |
| 14 | HCR-E | 80:20 | No change in 24 hrs. | No change in 24 hrs. |
| 15 | " | 60:40 | No change in 24 hrs. | No change in 24 hrs. |
| 16 | HCR-F | 80:20 | No change in 24 hrs. | No change in 24 hrs. |
| 17 | " | 60:40 | No change in 24 hrs. | No change in 24 hrs. |

Paper specimens are prepared in the same manner as in Example 1 using as papermaking sizing compositions the dispersions No. 8 to No. 17 prepared in this example, the dispersions No. 4 and No. 6 prepared in Example 1 and, for comparison, a commercial aqueous dispersion of ketene dimer (nonvolatile content 16.2%, pH 3.6, viscosity 8 cps), except that the paper stocks are prepared by adding the dispersions in an amount of 0.15% (calculated as nonvolatile component) based on the pulp and thereafter adding as a fixing agent 0.05% (calculated as nonvolatile component) of the following cationic high-molecular-weight substance to the pulp slurry, based on the pulp.

Fixing agent

A copolymer of 80 mole % of acrylamide and 20 mole % of dimethylaminoethyl methacrylate, having a pH of 3 and a viscosity of 20000 cps at 25° C. when made into a 5% aqueous solution.

The paper specimens obtained are tested for properties with the results listed in Table 4.

TABLE 4

| Sizing comp. No. | Sizing degree (sec) | Burst factor | Coefficient of friction |
|---|---|---|---|
| 4 | 23.9 | 3.42 | 0.439 |
| 6 | 22.8 | 3.65 | 0.455 |
| 8 | 22.4 | 3.45 | 0.433 |
| 9 | 21.2 | 3.51 | 0.442 |
| 10 | 23.6 | 3.50 | 0.441 |
| 11 | 23.4 | 3.67 | 0.462 |
| 12 | 22.9 | 3.46 | 0.432 |
| 13 | 20.8 | 3.55 | 0.444 |
| 14 | 23.5 | 3.51 | 0.434 |
| 15 | 22.1 | 3.68 | 0.467 |
| 16 | 23.3 | 3.43 | 0.440 |
| 17 | 23.0 | 3.64 | 0.458 |
| Commercial product | 12.1 | 3.30 | 0.411 |
| Blank | 0 | 3.77 | 0.472 |

EXAMPLE 3

In the same manner as in Example 1, aqueous dispersions are prepared from a mixture of the ketene dimer (KD) used in Example 1 and either one of the following noncrystalline hydrocarbon resins in a ratio by weight of 80:20. The dispersions have high stability and exhibit an outstanding sizing effect.

Noncrystalline hydrocarbon resin G (HCR-G)

Polyterpene resin 500 in molecular weight and 20° C. in softening point.

Noncrystalline hydrocarbon resin H (HCR-H)

Styrene oligomer 350 in molecular weight and 5° C. in softening point.

EXAMPLE 4

Noncrystalline hydrocarbon resin I (HCR-I)

Alicyclic hydrocarbon resin prepared by the hydrogenation of a petroleum resin derived from a $C_5$ fraction and a $C_9$ fraction, the hydrocarbon resin having a softening point of 70° C., a molecular weight of 700 and a bromine value of 6.

The KD used in Example 1 and HCR-I in the proportions (by weight) listed in Table 5 are mixed together with heating, and 50 g of the mixture, 125 g of 10% aqueous solution of the dispersant A and 290 g of distilled water are heated to 70° and pretreated in a homomixer. The resulting dispersion is further passed through a homogenizer (shearing pressure 350 kg/cm$^2$) twice at the same temperature to prepare a uniform dispersion. The dispersion is cooled and then filtered by a 350-mesh wire to obtain an aqueous dispersion. Little or no (less than 0.007%) solids are filtered off.

For comparison, the same procedure as above is repeated except that the KD and HCR-I are used respectively singly to obtain aqueous dispersions.

These aqueous dispersions contain about 15% of nonvolatile component, have a pH of 4.2 to 4.5 and a viscosity of 10 to 15 cps and composed of particles up to 0.5 μm in size.

In the same manner as in Example 1, the aqueous dispersions are tested for stability, with the results given in Table 5 below.

TABLE 5

| No. | KD:HCR-I (by wt.) | Stability Method (a) | Stability Method (b) |
|---|---|---|---|
| 1 | 100:0 | Gelation in 6 hrs. | Gelation in 2.5 hrs. |
| 2 | 95:5 | No change in 6 hrs. | No change in 6 hrs. |
| 3 | 90:10 | No change in 6 hrs. | No change in 6 hrs. |
| 4 | 80:20 | No change in 6 hrs. | No change in 6 hrs. |
| 5 | 70:30 | No change in 6 hrs. | No change in 6 hrs. |
| 6 | 60:40 | No change in 6 hrs. | No change in 6 hrs. |
| 7 | 0:100 | No change in 6 hrs. | No change in 6 hrs. |

Paper specimens are prepared in the same manner as in Example 1 with use of the seven dispersions listed above and a commercial aqueous dispersion of ketene dimer (nonvolatile component 16.2%, pH 3.6, viscosity 8 cps) as papermaking sizing compositions. In the same manner as in Example 1, the Stöckigt sizing degree (JIS P 8122), burst factor (JIS P 8112) and coefficient of friction (JIS C 6244) of the paper specimens are measured. Table 6 shows the results.

For comparison, an aqueous dispersion of KD and an aqueous dispersion of HCR-I are mixed together in ratios by weight of 80:20 and 60:40 to obtain mixtures, which are tested as sizing compositions No.c and No.d respectively in the same manner as above. The results are also given in Table 6.

TABLE 6

| Sizing comp. No. | Sizing degree (sec) | Burst factor | Coefficient of friction |
|---|---|---|---|
| 1 | 24.8 | 3.20 | 0.428 |
| 2 | 26.2 | 3.30 | 0.440 |
| 3 | 25.7 | 3.35 | 0.451 |
| 4 | 25.1 | 3.40 | 0.462 |
| 5 | 24.1 | 3.45 | 0.471 |
| 6 | 23.5 | 3.51 | 0.481 |
| 7 | 0 | 3.67 | 0.485 |
| Commercial product | 0 | — | — |
| Commercial* product | 1.5 | — | — |
| c | 16.5 | — | — |
| d | 7.0 | — | — |
| (Blank) | 0 | 3.81 | 0.490 |

In Table 6, the commercial product marked with * is used in an amount of 0.5% (calculated as nonvolatile component) based on the pulp and the mark "-" indicates that the specimens are not measured.

EXAMPLE 5

Noncrystalline hydrocarbon resin J (HCR-J)

Petroleum resin derived from a $C_5$ fraction and having a softening point of 70° C., a molecular weight of 800 and a bromine value of 25.

Noncrystalline hydrocarbon resin K (HCR-K)

Petroleum resin derived from a $C_5$ fraction and a $C_9$ fraction and having a softening point of 90° C., a molecular weight of 900 and a bromine value of 40.

Noncrystalline hydrocarbon resin L (HCR-L)

Terpene resin 80° C. in softening point and 700 in molecular weight.

Noncrystalline hydrocarbon resin M (HCR-M)

Alicyclic saturated hydrocarbon resin prepared by the hydrogenation of aromatic petroleum resin from a $C_9$ fraction and having a softening point of 100° C. a molecular weight of 700 and a bromine value of 5.

Ketene dimer-incorporating sizing compositions are prepared in the same manner as in Example 4 except that the above noncrystalline hydrocarbon resins are used in the proportions listed in Table 7 in place of the HCR-I. The dispersions are comparable to those in Example 4 in nonvolatile content, pH, viscosity and particle size. The dispersions are also tested for stability with the results given in Table 7.

TABLE 7

| No. | HCR | KD:HCR (by wt.) | Stability Method (a) | Stability Method (b) |
|---|---|---|---|---|
| 8 | HCR-J | 60:40 | No change in 6 hrs. | No change in 6 hrs. |
| 9 | HCR-K | 90:10 | No change in 6 hrs. | No change in 6 hrs. |
| 10 | " | 60:40 | No change in 6 hrs. | No change in 6 hrs. |

TABLE 7-continued

| No. | HCR | KD:HCR (by wt.) | Stability Method (a) | Stability Method (b) |
|---|---|---|---|---|
| 11 | HCR-L | 60:40 | No change in 6 hrs. | No change in 6 hrs. |
| 12 | HCR-M | 60:40 | No change in 6 hrs. | No change in 6 hrs. |

No change is found even in 12 hours in each of the dispersions tested for stability by methods (a) and (b).

Paper specimens are prepared in the same manner as in Example 4 using as papermaking sizing compositions the dispersions No.8 and No.12 prepared in this example, the dispersions No.3 and No.6 prepared in Example 4 and, for comparison, a commercial aqueous dispersion of ketene dimer (nonvolatile content 16.2%, pH 3.6, viscosity 8 cps), except that the paper stocks are prepared by using the dispersions in an amount of 0.15% (calculated as nonvolatile component) based on the pulp and thereafter adding as a fixing agent 0.05% (calculated as nonvolatile component) of the same cationic high-molecular-weight substance as used in Example 2, based on the pulp.

The paper specimens obtained are tested with the results given in Table 8.

TABLE 8

| Sizing comp. No. | Sizing degree (sec) | Burst factor | Coefficient of friction |
|---|---|---|---|
| 3 | 23.7 | 3.40 | 0.441 |
| 6 | 21.8 | 3.64 | 0.453 |
| 8 | 20.2 | 3.66 | 0.457 |
| 9 | 22.6 | 3.37 | 0.438 |
| 10 | 21.2 | 3.62 | 0.458 |
| 11 | 20.5 | 3.58 | 0.455 |
| 12 | 23.2 | 3.61 | 0.467 |
| Commercial product | 11.8 | 3.20 | 0.412 |
| (Blank) | 0 | 3.79 | 0.478 |

EXAMPLE 6

In the same manner as in Example 4, aqueous dispersions are prepared from a mixture of the ketene dimer (KD) used in Example 4 and either one of the following noncrystalline hydrocarbon resins in a ratio by weight of 90:10. The dispersions have high stability and exhibit an outstanding sizing effect.

Noncrystalline hydrocarbon resin N

Alicyclic hydrocarbon resin prepared by the thermal polymerization of dicyclopentadiene, followed by hydrogenation and having a softening point of 100° C., a molecular weight of 450 and a bormine value of 15.

Noncrystalline hydrocarbon resin P

Copolymer of piperylene and 2-methyl-2-butene having a softening point of 95° C., a molecular weight of 1300 and a bromine value of 43.

We claim:

1. A sizing composition for cellulosic fiber sheets comprising water and finely divided solid particles dispersed in the water, said solid particles being a uniform mixture of about 40 to about 96% by weight of a ketene dimer and about 4 to about 60% by weight of a noncrystalline hydrocarbon resin formed by dissolving one in the other.

2. A sizing composition as defined in claim 1 wherein said ketene dimer is represented by the formula

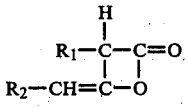

wherein $R_1$ and $R_2$ are the same or different and each represent a hydrocarbon group having 8 to 30 carbon atoms.

3. A sizing composition as defined in claim 2 wherein said $R_1$ and $R_2$ are the same or different and each represent an alkyl group having 8 to 30 carbon atoms.

4. A sizing composition as defined in claim 3 wherein said $R_1$ and $R_2$ are the same or different and each represent an alkyl group having 10 to 20 carbon atoms.

5. A sizing composition as defined in claim 1 wherein the noncrystalline hydrocarbon resin has an average molecular weight of about 300 to about 3000.

6. A sizing composition as defined in claim 1 wherein said solid particles are a uniform mixture of about 50 to about 95% by weight of the ketene dimer and about 5 to about 50% by weight of the noncrystalline hydrocarbon resin formed by dissolving one in the other.

7. A process for preparing a sizing composition claimed in claim 1 comprising melting together a ketene dimer and a noncrystalline hydrocarbon resin to dissolve one component in the other and to obtain a uniform mixture of about 40 to about 96% by weight of the ketene dimer and about 4 to about 60% by weight of the noncrystalline hydrocarbon resin, and dispersing the resulting uniform mixture in water.

* * * * *